US007462020B2

(12) United States Patent
Reinert

(10) Patent No.: US 7,462,020 B2
(45) Date of Patent: Dec. 9, 2008

(54) CONCRETE PUMP WITH PIVOTABLE HOPPER ASSSEMBLY

(75) Inventor: Gerald H. Reinert, Cold Spring, KY (US)

(73) Assignee: Reinert Manufacturing Inc., Florence, KY (US)

( * ) Notice: Subject to any disclaimer, the term of this patent is extended or adjusted under 35 U.S.C. 154(b) by 794 days.

(21) Appl. No.: 10/856,151

(22) Filed: May 28, 2004

(65) Prior Publication Data

US 2005/0265871 A1 Dec. 1, 2005

(51) Int. Cl.
*F04B 53/10* (2006.01)
*F04B 7/00* (2006.01)
*F04B 15/00* (2006.01)
*F04B 15/02* (2006.01)

(52) U.S. Cl. ..... 417/532; 417/454; 417/516; 417/517; 417/533; 417/900

(58) Field of Classification Search ..... 417/401, 417/403, 510, 523, 531, 532, 533, 900, 454, 417/516, 517, 518, 519
See application file for complete search history.

(56) References Cited

U.S. PATENT DOCUMENTS 3,612,730 A 10/1971 Reinert
3,897,180 A 7/1975 Reinert
3,963,385 A * 6/1976 Caban ..... 417/517
4,241,641 A 12/1980 Reinert
4,345,883 A * 8/1982 Westerlund et al. ..... 417/317
4,563,135 A * 1/1986 Riker ..... 417/517
4,614,483 A * 9/1986 Hudelmaier ..... 417/517
4,653,990 A * 3/1987 Schlecht ..... 417/517
4,869,655 A * 9/1989 Powers et al. ..... 417/360
5,857,490 A * 1/1999 Kao ..... 137/625.45
6,305,916 B1 10/2001 Reinert
6,308,916 B1 * 10/2001 Reinert ..... 417/454
6,338,615 B1 * 1/2002 Hurr et al. ..... 417/517
2003/0215344 A1 * 11/2003 Condon et al. ..... 417/518

* cited by examiner

*Primary Examiner*—Devon C Kramer
*Assistant Examiner*—Leonard J Weinstein
(74) *Attorney, Agent, or Firm*—Greer, Burns & Crain, Ltd.

(57) ABSTRACT

A concrete pump with a pivoting valve and hopper assembly is provided with a novel wear plate and wear ring. The wear plate is mounted on the frame of the pump and remains mounted on the frame as the valve and hopper assembly pivots between open and closed positions. When the valve and hopper assembly is open, the wear plate is accessible for examination and replacement. The hopper is provided with an opening through which the wear plate extends when the valve and hopper assembly is closed. A seal on the hopper around the opening sealingly engages the frame. A wear ring on the valve engages the wear plate when the valve and hopper assembly is closed. A cam plate on each side of the frame is engageable with the valve and hopper assembly as the assembly pivots to a closed position to ensure alignment between the valve and hopper assembly and the frame.

12 Claims, 7 Drawing Sheets

CONCRETE PUMP WITH PIVOTABLE HOPPER ASSSEMBLY

BACKGROUND

This invention relates to concrete pumps, and, more particularly, to a concrete pump with a hopper and a pivotable S-tube valve assembly.

Concrete pumps are well known in the construction industry and are used for pumping concrete or other pumpable construction materials. Concrete pumps are described, for example, in U.S. Pat. Nos. 3,612,730, 3,897,180, 4,241,641, and 6,305,916.

Most concrete pumps which are currently being manufactured include two concrete pumping cylinders and an S-shaped tube valve for alternately connecting the outlet end of each pumping cylinder to the discharge conduit of the concrete pump. The S-tube valve is pivotably mounted in a concrete hopper. As the piston in one of the pumping cylinders moves toward the hopper to pump concrete through the S-tube valve to the discharge conduit, the piston in the other pumping cylinder retracts away from the hopper to draw concrete into the cylinder.

A typical S-tube valve assembly is described in U.S. Pat. No. 6,305,916. The valve assembly includes an S-tube and a mounting plate for the S-tube which is pivotally mounted on the hopper. A wear ring is mounted in an opening in the valve assembly and engages a wear plate on the hopper.

U.S. Pat. No. 6,305,916 also describes an S-valve and hopper assembly which is pivotally mounted on the frame or chassis of the concrete pump. The valve and hopper assembly can swing away from the outlet ends of the pumping cylinders. The inlet end of the S-tube valve is thereby exposed for easy cleaning. The outlet ends of the pumping cylinders are also exposed to permit the piston seals to be changed.

However, the wear plate and wear ring which provide a seal as the S-tube valve pivots within the hopper are mounted inside the hopper. The wear plate and wear ring therefore cannot be easily inspected or changed. Those parts can be changed only after the S-tube valve is disassembled.

SUMMARY OF THE INVENTION

The invention provides a concrete pump with a pivotable S-valve and hopper assembly in which the wear plate and the wear ring can be easily inspected and changed. The wear plate is mounted on the frame of the pump and does not move as the valve and hopper assembly pivot. The front wall of the hopper is provided with an opening through which the wear plate extends when the valve and hopper assembly is pivoted against the frame. A low pressure seal on the front wall of the hopper sealingly engages the frame. A seal ring is mounted on the front end of the S-tube valve and engages the wear plate when the valve and hopper assembly is pivoted to its closed position against the frame. When the valve and hopper assembly are pivoted to an open position, the wear ring and wear plate are separated and can be inspected and/or changed without difficulty. Cam plates on the frame engage the valve and hopper assembly as the valve and hopper assembly pivots to the closed position and ensure alignment between the valve and hopper assembly and the frame.

DESCRIPTION OF THE DRAWING

The invention will be explained in conjunction with an illustrative embodiment shown in the accompanying drawing in which—

DESCRIPTION OF SPECIFIC EMBODIMENT

Figure 1:
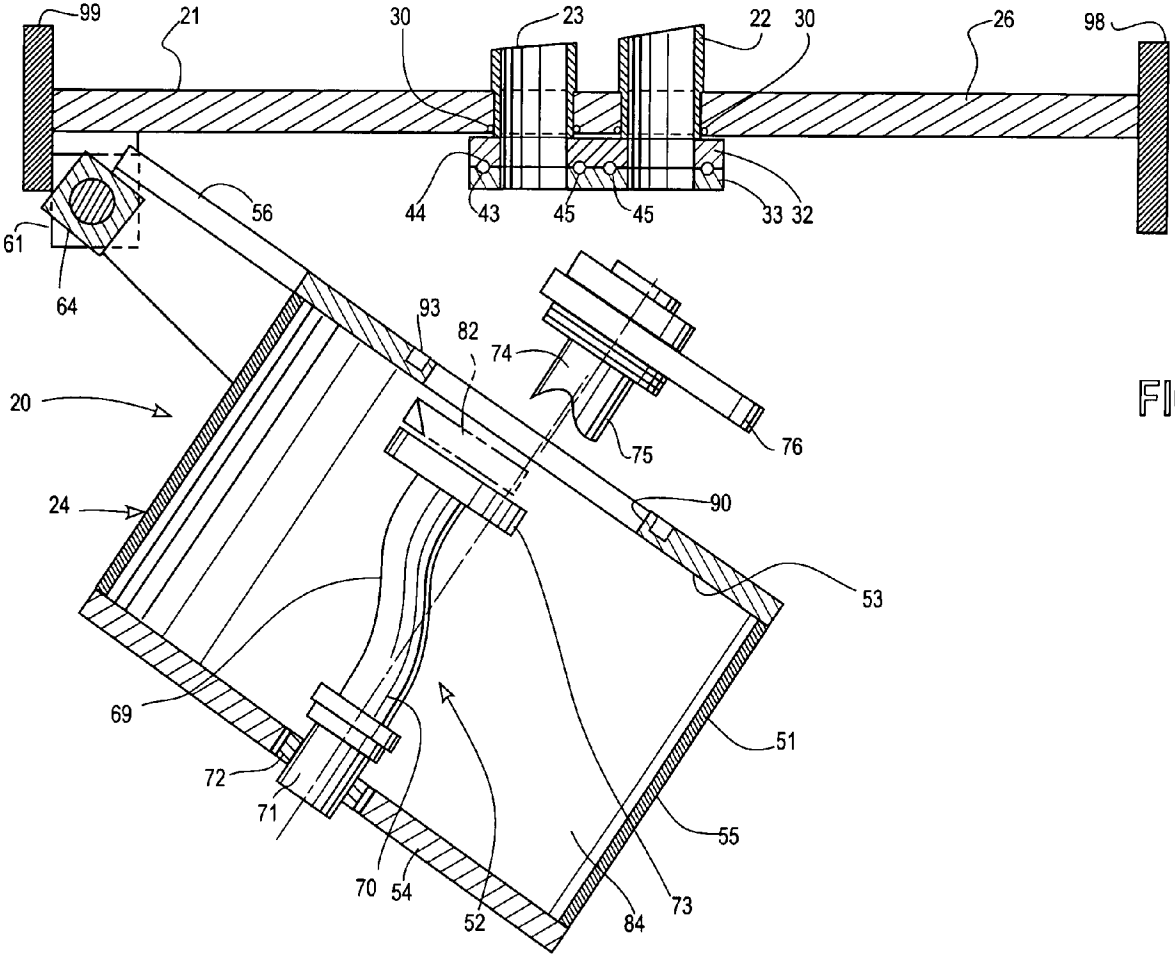
FIG. 1 is a fragmentary horizontal sectional view of a pivotable valve and hopper assembly and the outlet ends of a pair of pumping cylinders, the valve and hopper assembly being pivoted away from the pumping cylinders to an open position.
Figure 2:
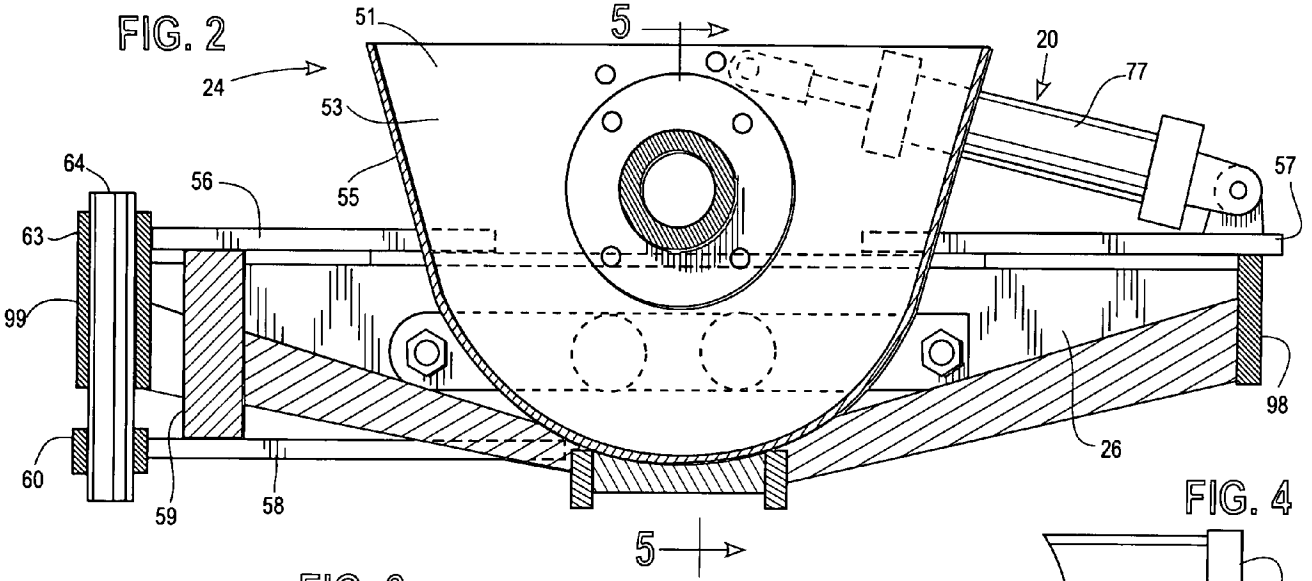
FIG. 2 is a vertical sectional view of the valve and hopper assembly in the closed position.
Figure 4:
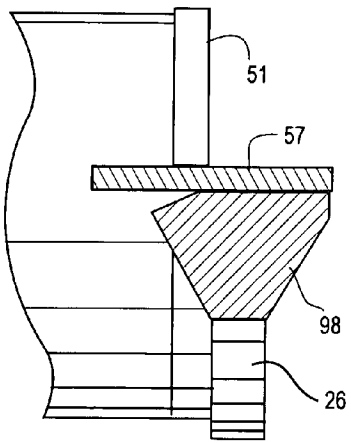
FIG. 4 is a side elevational view taken along the line 4-4 of FIG. 2.
Figure 3:
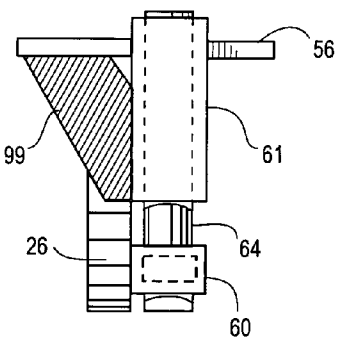
FIG. 3 is a side elevational view taken along the line 3-3 of FIG. 2.
Figure 5:
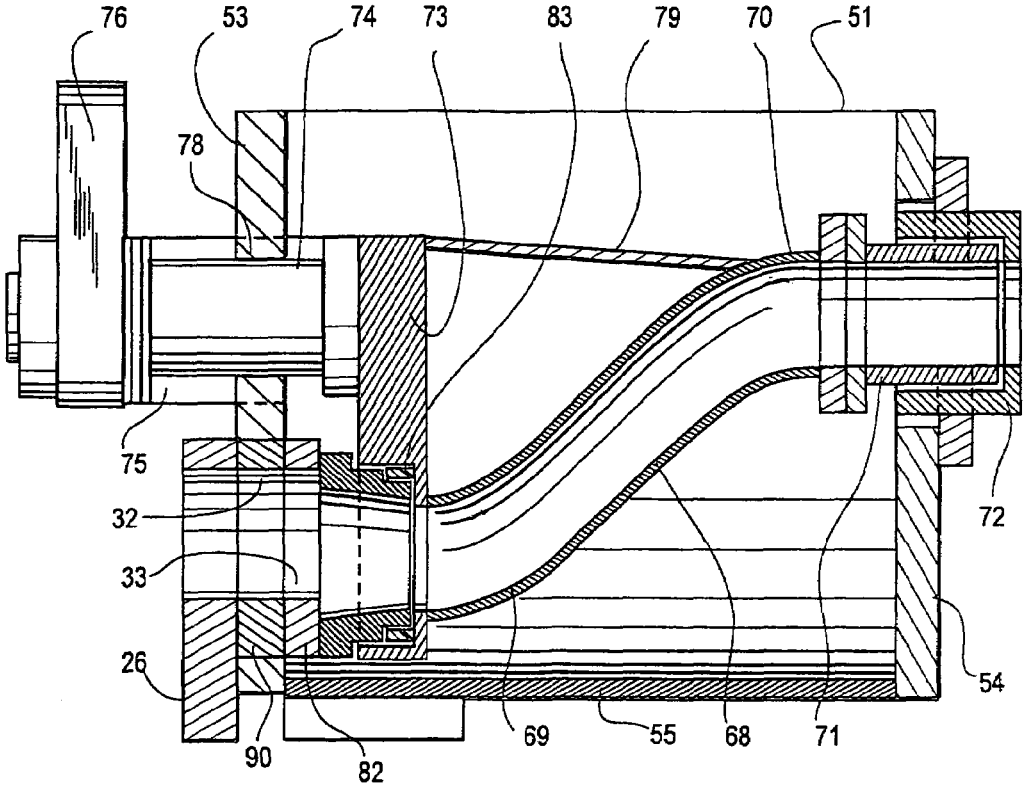
FIG. 5 is a sectional view of the valve and hopper assembly taken along the line 5-5 of FIG. 2.

Referring to FIGS. 1 and 2, a concrete pump 20 includes a frame or chassis 21, a pair of pumping cylinders 22 and 23 on the frame, and an S-valve and hopper assembly 24 which is pivotably mounted on the frame. The S-valve and hopper assembly is pivotably mounted on the frame in accordance with U.S. Pat. No. 6,305,916.

The details of the pumping cylinders are described in U.S. Pat. Nos. 3,612,730, 3,897,180, 4,241,641, and 6,305,916.

Figure 9:
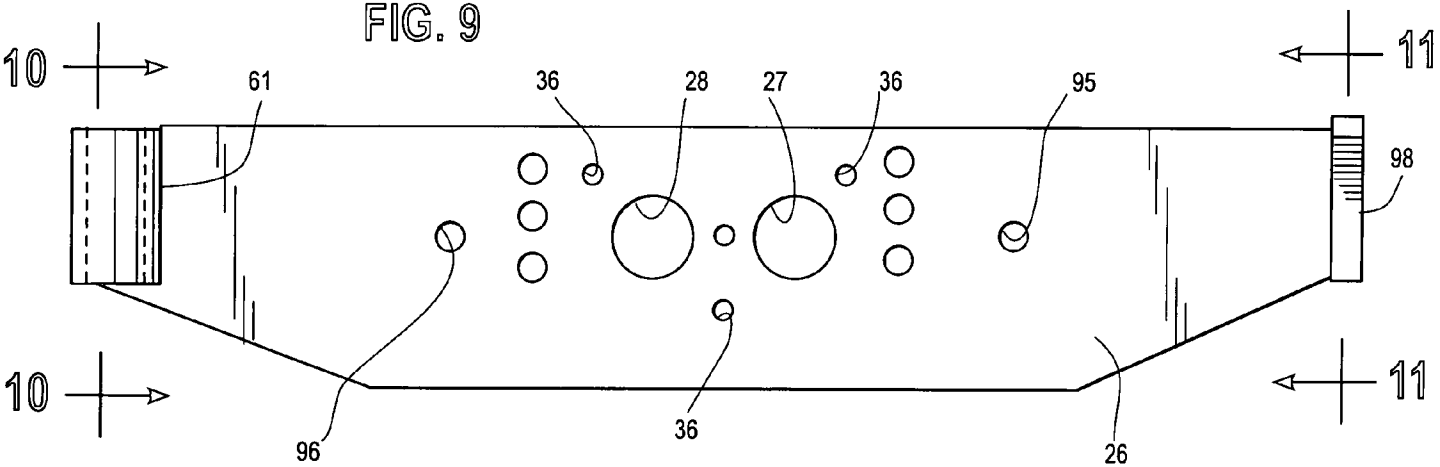
FIG. 9 is an elevational view of the hinge mounting plate.
Figure 11:
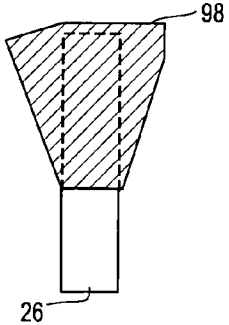
FIG. 11 is a sectional view taken along the line 11-11 of FIG. 9.

The frame includes a hinge mounting plate 26 at the rear end of the frame. Referring to FIG. 9, the hinge mounting plate is provided with a pair of openings 27 and 28 in which the outlet ends of the pumping cylinders 22 and 23 are mounted. An annular groove 29 surrounds each of the openings, and an O-ring 30 (FIG. 1) is mounted in each of the grooves.

Referring to FIGS. 1 and 12-15, a filler plate 32 and a wear plate 33 are bolted to the hinge mounting plate 26 by bolts which extend through bolt holes 34 (FIG. 12) in the wear plate, bolt holes 35 (FIG. 14) in the filler plate, and bolt holes 36 (FIG. 9) in the hinge mounting plate. The wear plate is provided with pump openings 38 and 39 and the filler plate is provided with pump openings 40 and 41 which are aligned with the outlet ends of the pumping cylinders.

The facing surfaces of the wear plate and the filler plate are provided with annular grooves 43 and 44, respectively (FIG. 1), surrounding each of the pump openings, and an O-ring 45 is mounted in each set of grooves. The O-rings 45 and 30 provide a high pressure seal against grout and concrete which is pumped through the pumping cylinders.

Referring to FIGS. 1, 2, 5, and 6, the valve and hopper assembly 24 includes a hopper 51 and an S-tube valve assembly 52. The hopper 51 includes flat front and rear walls 53 and 54 and a generally U-shaped wall 55 which forms the sides and bottom of the hopper. Left and right support plates 56 and 57 (FIGS. 1 and 2) are welded to the hopper and extend laterally outwardly from the hopper. A lower left support plate 58 is welded to the bottom of the hopper and extends laterally outwardly from the hopper. A vertical brace 59 connects the left support plates 56 and 58.

Figure 10:
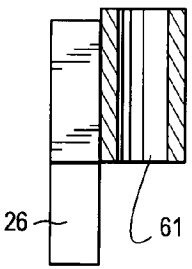
FIG. 10 is a sectional view taken along the line 10-10 of FIG. 9.
Figure 13:
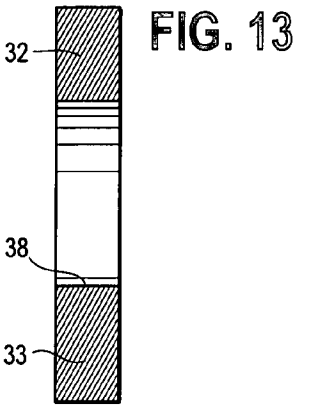
FIG. 13 is a sectional view taken along the line 13-13 of FIG. 13.
Figure 15:
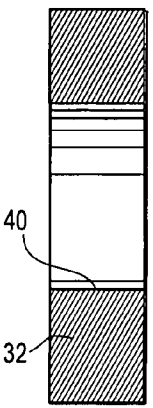
FIG. 15 is a sectional view taken along the line 15-15 of FIG. 14.
Figure 12:
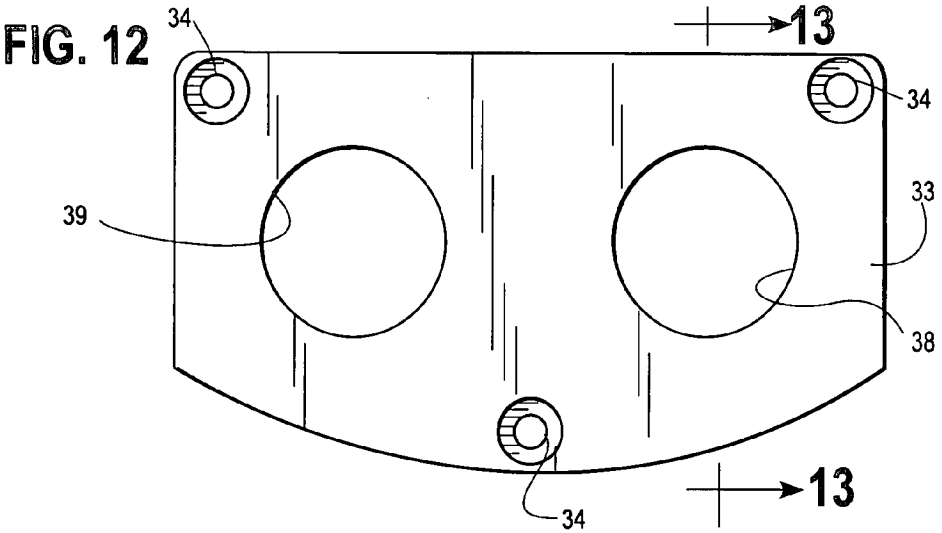
FIG. 12 is an elevational view of the wear plate.
Figure 14:
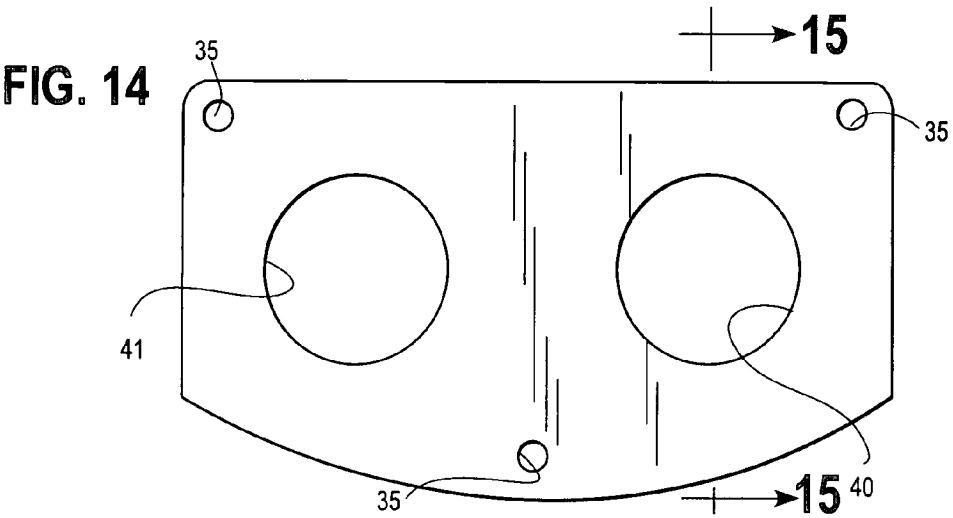
FIG. 14 is an elevational view of the filler plate.

A hinge sleeve 60 is mounted on the lower left support plate 58, and a hinge sleeve 61 (see also FIGS. 9 and 10) is attached to the hinge mounting plate 26. A pivot pin 64 extends through an opening 63 in the upper support plate 56 and through the hinge sleeves and pivotally attaches the valve and hopper assembly to the hinge mounting plate 21.

The S-tube valve assembly 52 is similar to the S-tube valve assembly described in U.S. Pat. No. 6,305,916. The valve assembly includes an S-shaped tube valve 68 which includes an inlet end 69 and an outlet end 70. The outlet end is connected to an S-tube extension 71 which is rotatably supported by a bearing 72 which is mounted in an outlet opening in the rear wall 54 of the hopper.

The inlet end 69 of the S-tube is supported by a mounting plate 73. A trunnion 74 is bolted to the top of the mounting plate 73 and is rotatably supported by bearing 75 which is mounted in an opening 78 in the front wall 53 of the hopper. The trunnion is rotated by a crank arm 76 and a hydraulic cylinder 77 which is supported on the right support plate 57. A reinforcing bar 79 is connected to the mounting plate 73 and the S-tube.

Figure 6:
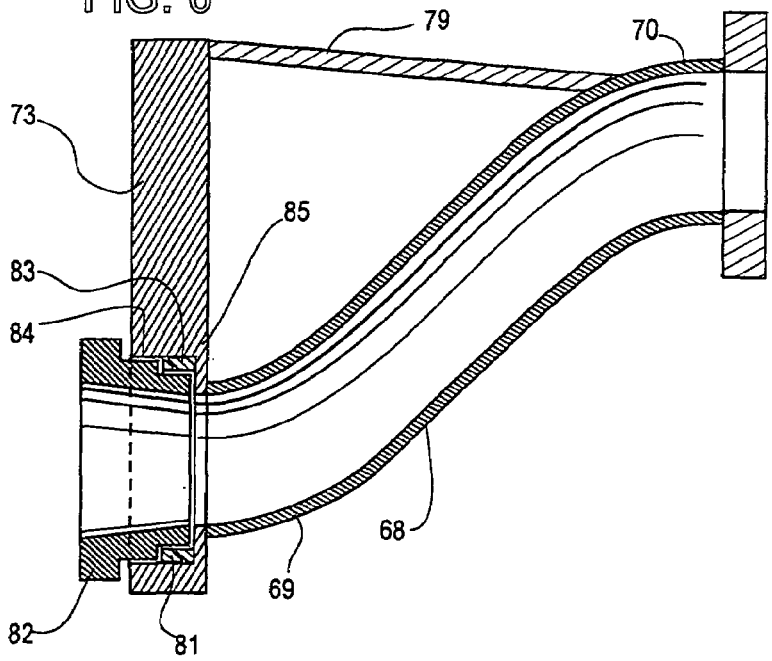
FIG. 6 is a sectional view of the S-tube valve and wear ring of FIG. 5.
Figure 8:
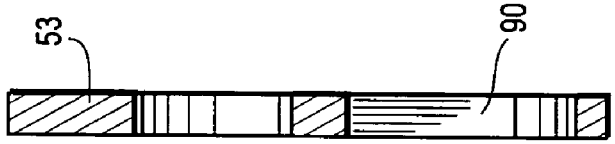
FIG. 8 is a sectional view taken along the line 8-8 of FIG. 7.
Figure 7:
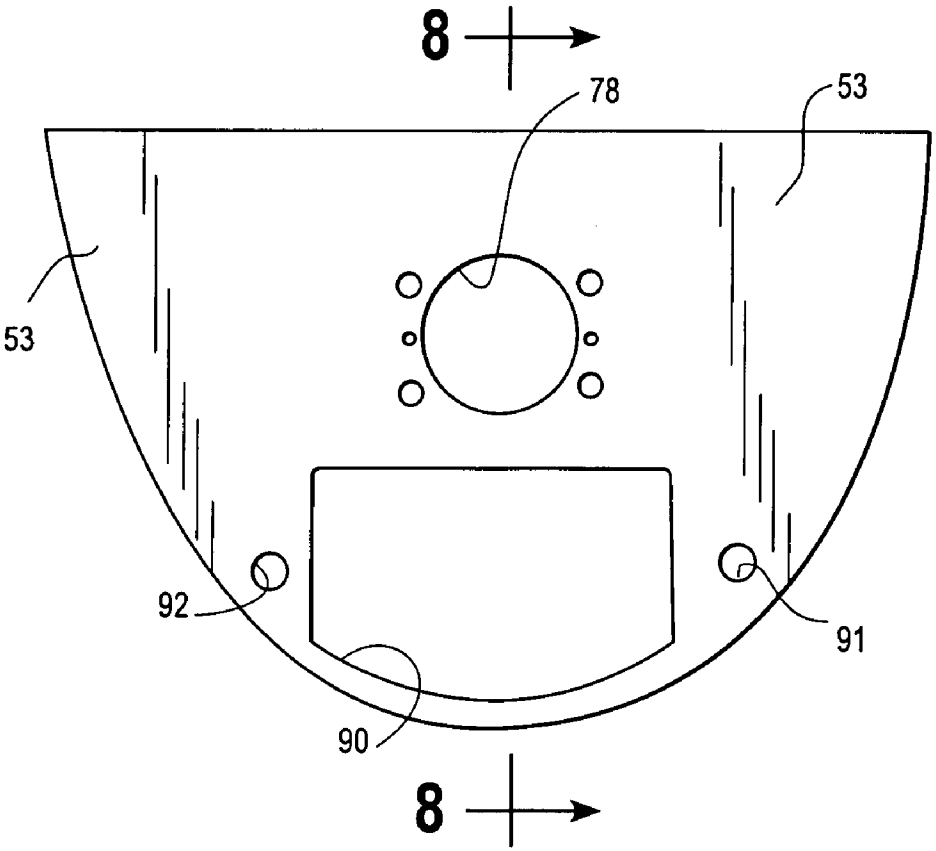
FIG. 7 is an elevational view of the front wall of the hopper.

Referring to FIG. 6, an opening 81 is provided in the mounting plate 73 which is aligned with the outlet end 69 of the S-tube. A wear ring 82 is slidably mounted in the opening 81, and a compressible and resilient rubber annular spring or expansion band 83 is positioned between annular flanges 84 and 85 on the wear ring and on the mounting plate.

Referring to FIGS. 1, 5, 7, and 8, the front wall 53 of the hopper is provided with an opening 90 which has the same shape as the peripheries of the wear plate 33 and the filler plate 32 and which is just slightly larger than the peripheries of the wear plate and filler plate. Bolt holes 91 and 92 are drilled and tapped on the right and left sides of the opening 90. A compressible and resilient gasket 93 (FIG. 1) is mounted in an annular groove which surrounds the opening 90 and is engageable with the hinge mounting plate 26 when the hopper is closed. When the hopper is closed, the bolt holes 91 and 92 in the hopper are aligned with bolt holes 95 and 96 (FIG. 9) in the hinge mounting plate 26.

Figure 16:
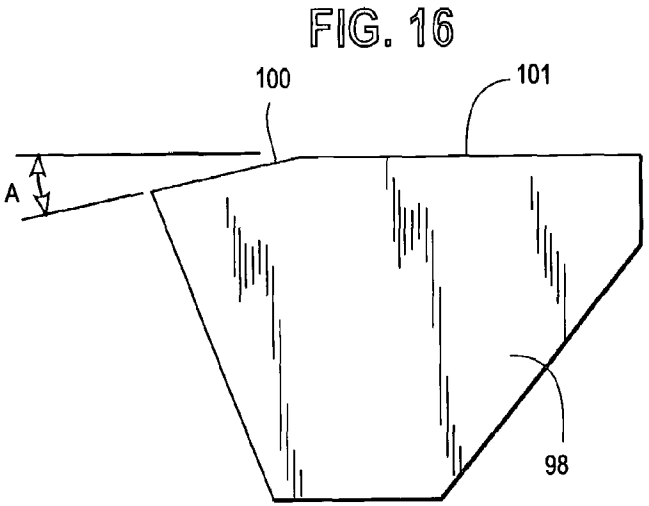
FIG. 16 is a side elevational view of the right side cam plate.
Figure 17:
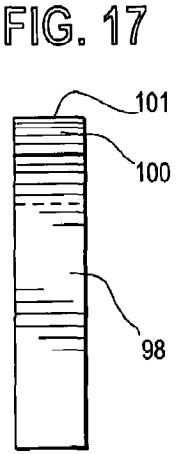
FIG. 17 is an end view of the cam plate of FIG. 15.

Right and left side cam plates 98 and 99 (FIGS. 1, 2-4 and 16-19) are welded to the right and left sides of the hinge mounting plate 26. Referring to FIGS. 16 and 17, the right side cam plate 98 includes an inclined camming surface 100 and a top horizontal support surface 101. In the particular embodiment illustrated, the inclined cam surface 100 is inclined at an angle A of 15° with respect to the horizontal surface 101.

Figure 18:
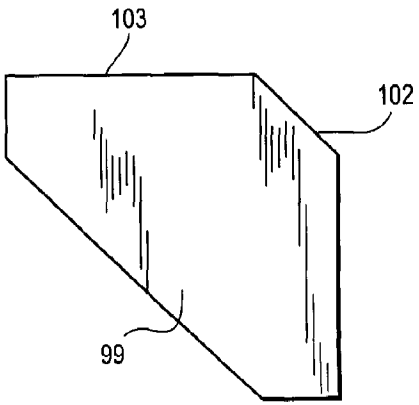
FIG. 18 is a side elevational view of the left side cam plate.
Figure 19:
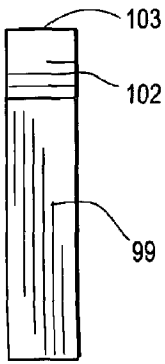
FIG. 19 is an end view of the cam plate of FIG. 18.

Referring to FIGS. 18 and 19, the left side cam plate 99 includes an inclined camming surface 102 and a top horizontal support surface 103. In the particular embodiment illustrated, the cam surface 102 is inclined at an angle of 45° from the horizontal surface 103.

FIG. 1 illustrates the valve and hopper assembly 24 in the open position in which the valve and hopper assembly is pivoted away from the hinge mounting plate 26. In this position the wear ring 82 of the S-tube valve assembly is accessible through the opening 90 in the hopper, and the wear plate 33 is exposed and accessible. The wear ring 82 and the expansion band 83 can therefore be easily inspected and changed if necessary. Similarly, the wear plate 33 is accessible and open for easy inspection and can be easily changed if necessary.

When the pump is to be operated, the valve and hopper assembly 24 is rotated on the hinge pin 64 so that the front wall 53 of the hopper abuts the hinge mounting plate 26. As the front wall 53 of the hopper approaches the hinge mounting plate 26, the wear plate 33 and filler plate 32 extend through the opening 90 in the hopper. As the hopper pivots toward the closed position, the left and right support plates 56 and 57 on the hopper engage the camming surfaces 100 and 102 of the right and left cam plates 98 and 99 and eventually ride on the horizontal support surfaces 101 and 103 of the cam plates. The cam plates insure that the parts of the pivoting valve and hopper assembly 24 are properly aligned with mating parts on the frame. For example, the opening 90 in the hopper will be aligned with the wear plate 33 and filler plate 32, the opening in the wear ring 82 will be aligned with one of the openings in the wear plate 33, and the bolt holes 91 and 92 in the hopper will be aligned with the bolt holes 95 and 96 in the hinge mounting plate.

After the valve or hopper assembly is pivoted to the closed position, bolts are inserted through the bolt holes 95 and 96 in the hinge mounting plate and are screwed into the tapped bolt holes 91 and 92 in the front wall of the hopper to secure the hopper in the closed position, to draw the seal 93 on the hopper into sealing engagement with the hinge mounting plate, and to draw the wear ring 82 on the S-valve assembly into engagement with the wear plate 33. After the valve and hopper assembly is closed, the hydraulic cylinder 77 can be operated to swing the wear ring 82 on the S-tube valve into alignment with the appropriate opening 38 or 39 in the wear plate 33. The cylinder 77, trunnion 74, and mounting plate 73 can swing the wear ring into alignment with either of the openings in the wear plate depending upon which of the pumping cylinders is pumping. The expansion band 83 resiliently urges the wear ring against the wear plate to provide a seal between those parts.

The O-rings 30 between the hinge mounting plate 26 and the filler plate 32, the O-rings 45 between the filler plate 32 and the wear plate 33, and the engagement between the wear ring 82 and the wear plate 33 provide high pressure seals which provide an effective seal for the concrete and grout which are pumped through the pumping cylinders 22 and 23 into the S-tube valve. The seal 93 is not required to withstand the high pressure which is created by the pumping cylinders, and the seal 93 can be a low pressure seal. The low pressure seal 93 has no bearing on the pumping ability of the pumping cylinders 22 and 23.

While in the foregoing specification a detailed description of specific embodiments of the invention was set forth for the purpose of illustration, it will be understood that many of the details hereingiven may be varied considerably by those skilled in the art without departing from the spirit and scope of the invention.

I claim:

1. A concrete pumping assembly comprising a frame, a pair of concrete pumping cylinders mounted on the frame, each of the pumping cylinders having an outlet end, a wear plate mounted on the frame adjacent the outlet ends of the pumping cylinders, the wear plate having a pair of openings, each of the openings in the wear plate being aligned with the outlet end of one of the pumping cylinders, a valve and hopper assembly pivotally mounted on the frame for movement between open and closed positions, the valve and hopper assembly including a hopper having front and rear walls, the front wall having an opening through which the wear plate on the frame extends when the valve and hopper assembly is in the closed position, an S-shaped tube valve having a first end pivotally mounted in the rear wall of the hopper and a second end which, when the valve and hopper assembly is in the closed position, is movable between a first position in which the second end of the S-shaped tube valve is aligned with one of the openings in the wear plate and a second position in which the second end of the S-shaped tube valve is aligned with the other opening in the wear plate, and a wear ring mounted adjacent the second end of the S-shaped valve tube, the wear ring engaging the wear plate on the frame when the valve and hopper assembly is in the closed position, the wear plate on the frame being separated from the wear ring and being exposed when the valve and hopper assembly is in the open position and the wear ring on the S-shaped tube valve being accessible through the opening in the front wall of the hopper when the valve and hopper assembly is in the open position.

2. The pump of claim 1 including a seal surrounding the opening in the front wall of the hopper which is engageable with the frame when the valve and hopper assembly is in the closed position.

3. The pump of claim 1 including a compressible and resilient expansion band engaging the wear ring and resiliently biasing the wear ring away from the second end of the S-shaped valve tube.

4. The pump of claim 1 including a filler plate between the wear plate and the frame, the filler plate having a pair of openings which are aligned with the openings in the wear plate.

5. The pump of claim 4 including first and second seals between the wear plate and filler plate, each of the seals surrounding one of the openings in the wear plate.

6. The pump of claim 5 including first and second seals between the filler plate and the frame, each of the seals surrounding one of the openings in the filler plate.

7. The pump of claim 1 in which the frame has first and second sides and the hopper includes first and second side walls, a first laterally outwardly extending plate attached to the first side wall of the hopper, a second laterally outwardly extending plate attached to the second side wall of the hopper, a first hinge member mounted on the frame adjacent to the first side of the frame, a second hinge member mounted on the first laterally outwardly extending plate attached to the first side wall of the hopper, a cam plate attached to the frame adjacent to the second side of the frame, the second laterally outwardly extending plate attached to the second side wall of the hopper being engageable with the cam plate as the valve and hopper assembly moves toward the closed position whereby the wear ring is cammed into alignment with the openings in the wear plate.

8. The pump of claim 7 in which bolt holes are provided in the frame and in the hopper for securing the hopper to the frame in the closed position, the bolt holes being cammed into alignment by the cam plate.

9. The pump of claim 7 including a second cam plate attached to the frame adjacent the first hinge member, said first laterally outwardly extending plate being engageable with the second cam plate as the valve and hopper assembly moves toward the closed position.

10. The pump of claim 1 in which the wear ring is removably mounted on the second end of the S-shaped valve tube whereby the wear ring can be changed when the valve and hopper assembly is in the open position.

11. The pump of claim 1 including a mounting plate supporting the second end of the valve tube, the wear ring being removably and slidably mounted in an opening in the mounting plate.

12. The pump of claim 11 including a compressible and resilient expansion band between the wear ring and the mounting plate.

* * * * *